US009299232B2

(12) United States Patent
Christianson et al.

(10) Patent No.: US 9,299,232 B2
(45) Date of Patent: Mar. 29, 2016

(54) SECURITY DEVICE WITH DUAL USE TRANSFORMER

(71) Applicant: Checkpoint Systems, Inc., Thorofare, NJ (US)

(72) Inventors: David P. Christianson, Charlotte, NC (US); Donald Matthew Johnson, Charlotte, NC (US)

(73) Assignee: CHECKPOINT SYSTEMS, INC., Thorofare, NJ (US)

( * ) Notice: Subject to any disclaimer, the term of this patent is extended or adjusted under 35 U.S.C. 154(b) by 167 days.

(21) Appl. No.: 14/137,435

(22) Filed: Dec. 20, 2013

(65) Prior Publication Data

US 2015/0179035 A1 Jun. 25, 2015

(51) Int. Cl.

| | |
|---|---|
| ***G08B 13/14*** | (2006.01) |
| ***G08B 13/24*** | (2006.01) |
| ***G07C 9/00*** | (2006.01) |

(Continued)

(52) U.S. Cl.

CPC ..... *G08B 13/2402* (2013.01); *G07C 9/00182* (2013.01); *G08B 13/2431* (2013.01); *G08B 13/2434* (2013.01); *G08B 25/10* (2013.01); *G07C 2009/00777* (2013.01); *G08B 25/008* (2013.01)

(58) Field of Classification Search

CPC ..... G08B 13/2402; G08B 25/10; G08B 13/2434; G08B 13/2431; G08B 25/008; G07C 9/00182; G07C 2009/00777

USPC ..... 340/572.1, 572.7, 572.8, 572.9, 340/572.2–572.6, 568.1, 568.2, 568.4, 571; 70/57.1, 18, 53, 63

See application file for complete search history.

(56) References Cited

U.S. PATENT DOCUMENTS

| | | | | |
|---|---|---|---|---|
| 5,153,583 | A * | 10/1992 | Murdoch | G06K 7/0008 340/10.34 |
| 6,243,005 | B1 * | 6/2001 | Haimovich | G09F 3/0329 340/427 |
| 6,384,711 | B1 | 5/2002 | Cregger | |

(Continued)

FOREIGN PATENT DOCUMENTS

| | | |
|---|---|---|
| EP | 1439487 A2 | 7/2004 |
| JP | 2000057445 A | 2/2000 |

(Continued)

OTHER PUBLICATIONS

Extended European Search Report and Written Opinion of corresponding European Application No. 14198595.2, mailed May 18, 2015, all enclosed pages cited.

*Primary Examiner* — Anh V La

(74) *Attorney, Agent, or Firm* — Nelson Mullins Riley & Scarborough LLP

(57) ABSTRACT

A security device may include an attachment assembly configured to affix the security device to an object, a locking assembly configured to lockably secure the attachment assembly and configured to transition between at least a locked state and an unlocked state, a transformer configured to drive an alarm assembly to generate an alarm, and processing circuitry. The transformer may be further configured to operate as a wireless receiver to receive a remotely transmitted wireless signal. The processing circuitry may be configured to monitor an output of the transformer to determine whether the wireless signal has been received via the transformer, and selectively activate the transformer to drive the alarm assembly to generate the alarm.

20 Claims, 8 Drawing Sheets

(51) Int. Cl.

| | |
|---|---|
| ***G08B 25/10*** | (2006.01) |
| *G08B 25/00* | (2006.01) |

(56) References Cited

U.S. PATENT DOCUMENTS

| | | | | |
|---|---|---|---|---|
| 6,420,971 | B1 | 7/2002 | Leck | |
| 6,731,212 | B2 * | 5/2004 | Hirose | E05B 45/005 340/572.1 |
| 6,900,720 | B2 | 5/2005 | Denison | |
| 7,474,209 | B2 * | 1/2009 | Marsilio | E05B 45/005 340/568.1 |
| 7,737,843 | B2 | 6/2010 | Belden, Jr. | |
| 7,737,844 | B2 | 6/2010 | Scott | |
| 7,737,845 | B2 | 6/2010 | Fawcett | |
| 7,737,846 | B2 | 6/2010 | Belden, Jr. | |
| 8,144,014 | B1 | 3/2012 | Yang | |
| 2004/0217857 | A1 | 11/2004 | Lennartz et al. | |
| 2006/0139170 | A1 | 6/2006 | Ott | |
| 2011/0115632 | A1 | 5/2011 | Yang | |
| 2011/0227706 | A1 | 9/2011 | Yang | |

FOREIGN PATENT DOCUMENTS

| | | | |
|---|---|---|---|
| WO | 8905067 | A1 | 6/1989 |
| WO | 0154048 | A2 | 7/2001 |
| WO | 02097754 | | 12/2002 |
| WO | 2004066234 | A1 | 8/2004 |

* cited by examiner

SECURITY DEVICE WITH DUAL USE TRANSFORMER

TECHNICAL FIELD

Various example embodiments relate generally to retail theft deterrent and merchandise protection devices and methods.

BACKGROUND

Retail stores continuously strive to improve relative to their capabilities for protecting merchandise items. Given the many different product materials, packaging materials, shapes and sizes of merchandise items, it can be appreciated that protection of such items is rarely accomplished via a "one size fits all" approach. Instead, it is often the case that different styles and functions for security devices are employed for protection of respective different items.

In this regard, for example, some security devices are pinned or otherwise affixed to merchandise items, some security devices are wrapped around merchandise items, and some security devices entirely contain merchandise items or at least a portion of such items. The security devices can also employ different security measures. In some cases, the security devices may activate a local, audible alarm. In other cases, the security devices may activate a gate alarm or other remote notification system. In still other cases, the security device may simply be extremely difficult to open, or may release ink or in some other way devalue the item if the security tag is tampered with.

Regardless of the merchandise being protected or the specific measures employed, retail stores and other businesses have a continuous desire to reduce losses through theft. Although better security devices are always likely to remain in demand, there is a matching desire to increase effectiveness while reducing the cost of the security devices, and reducing the cost of the corresponding systems that supplement the security devices.

BRIEF SUMMARY OF SOME EXAMPLES

Accordingly, some example embodiments may provide for improved functionality of devices by using components that can serve dual purposes. Cost increase can therefore be avoided, while increased functionality is achieved.

In one example embodiment, a security device is provided. The security device may include an attachment assembly configured to affix the security device to an object, a locking assembly configured to lockably secure the attachment assembly and configured to transition between at least a locked state and an unlocked state, a transformer configured to drive an alarm assembly to generate an alarm, and processing circuitry. The transformer may be further configured to operate as a wireless receiver to receive a remotely transmitted wireless signal. The processing circuitry may be configured to monitor an output of the transformer to determine whether the wireless signal has been received via the transformer, and selectively activate the transformer to drive the alarm assembly and generate the alarm. According to some example embodiments, the processing circuitry may be further configured to activate the transformer to drive the alarm assembly to generate the alarm in response to the attachment assembly being compromised. In some example embodiments, the processing circuitry may be further configured to activate the transformer to drive the alarm assembly to generate the alarm in response to determining that the locking assembly has transitioned from the locked state to the unlocked state without having received the wireless signal via the transformer. In some example embodiments, the attachment assembly includes a sense loop, and wherein processing circuitry is further configured to activate the transformer to drive the alarm assembly to generate the alarm in response to the sense loop being compromised. In some example embodiments, the processing circuitry may be further configured to, in response to receiving the wireless signal, receive the remotely transmitted wireless signal via the transformer, verify the remotely transmitted wireless signal, and open a window of time during which activation of the transformer to drive the alarm assembly is prevented so as to permit the locking assembly to be transitioned for the locked state to the unlocked state without generating an alarm. In some example embodiments, the wireless signal may comprise a transmitted code. In some example embodiments, the security device may further comprise a memory configured to store a verification code, and the processing circuitry may be further configured to determine whether the transmitted code matches the verification code. According to some example embodiments, the verification code may be fixed, or not overwritable, when the locking assembly is in the locked state, and programmable or overwritable when the locking assembly is in the unlocked state, and, in some example embodiments, the alarming assembly is not generating a alarm. According to some example embodiments, the security device may further comprise a memory configured to store a verification code, and the processing circuitry may be further configured to overwrite the verification code with the transmitted code responsive to receipt of the transmitted code while the security device is in the unlocked state. In some example embodiments, the alarm assembly comprises a piezo sounder. In some example embodiments, the transformer forms a portion of a tuned circuit configured to receive the wireless signal. In some example embodiments, the tuned circuit is configured to receive the wireless signal from an electronic key, and the electronic key may comprise at least one magnet configured to magnetically interact with the security device to transition the security device to the unlocked state. In some example embodiments, the processing circuitry may be configured to define a listening period during generation of the alarm to enable the transformer to stop driving the alarm assembly to listen for the wireless signal.

According to another example embodiment, a method of employing a security device is provided. The method may include monitoring, via processing circuitry, a locking assembly configured to lockably secure an attachment assembly to an object. The monitoring of the locking assembly may be performed to determine whether the locking assembly has transitioned between a locked state and an unlocked state. The processing circuitry, the locking assembly, and the attachment assembly may be components of a security device. The method may further comprise monitoring an output of a transformer of the security device, via the processing circuitry, to determine whether a wireless signal has been received via the transformer. The method may further include selectively activating the transformer to drive an audible alarm based on whether the wireless signal has been received and whether the locking assembly has transitioned from the locked state to the unlocked state. According to some example embodiments, selectively activating the transformer to drive the audible alarm may comprise determining whether the wireless signal includes a transmitted code that matches a verification code. Further, according to some example embodiments, the method may include storing a code provided with the wireless signal as a verification code responsive to receiving the wireless signal while the locking assembly is in the unlocked state. According to some example embodiments, the method may further comprise, in response to receiving the wireless signal, receiving the wireless signal via the transformer, verifying the wireless signal, and opening a window of time during which activation of the transformer to drive the alarm assembly is prevented so a to permit the locking assembly to be transitioned for the locked state to the unlocked state without generating an alarm.

According to still another example embodiment, a device interface for a security device that is affixable to an object is provided. The device interface may include receiver circuitry configured to detect receipt of a wireless signal, and a transformer in communication with the receiver circuitry and in communication with an alarm assembly of the security device to selectively drive the alarm assembly responsive to instruction from processing circuitry of the security device. The processing circuitry may be configured to determine whether a locking assembly configured to lockably secure an attachment assembly of the security device is in a locked state or an unlocked state, to monitor to determine whether the wireless signal has been received via the transformer, and to selectively activate the transformer to drive the alarm assembly to generate the alarm. According to some example embodiments, the transformer may form a portion of a tuned circuit configured to receive the wireless signal. According to some example embodiments, the tuned circuit may be configured to receive the wireless signal from an electronic key, the electronic key comprising at least one magnet configured to magnetically interact with the security device to transition the security device to the unlocked state.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 6A:
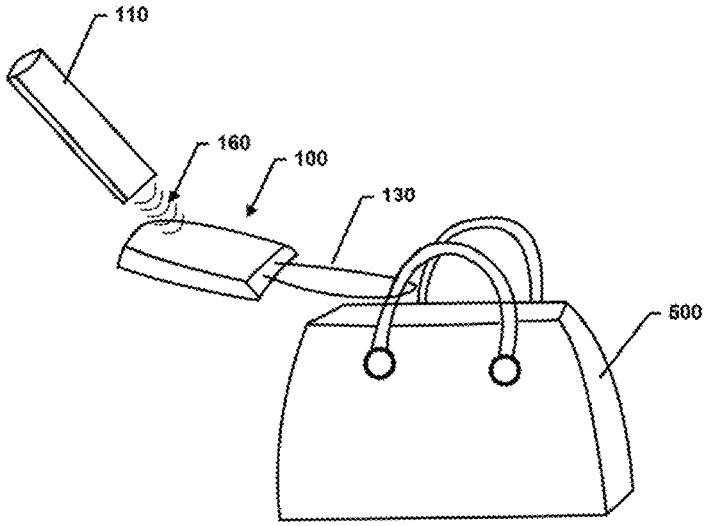
Figure 6B:
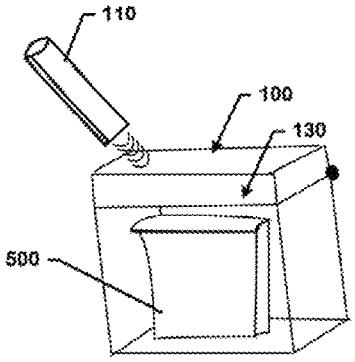
Figure 6C:
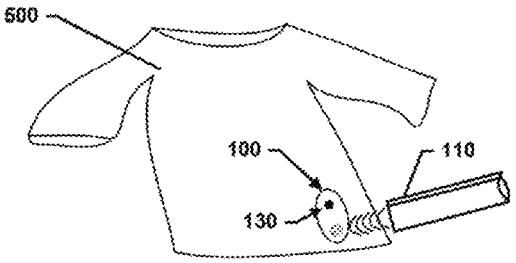
Figure 6D:
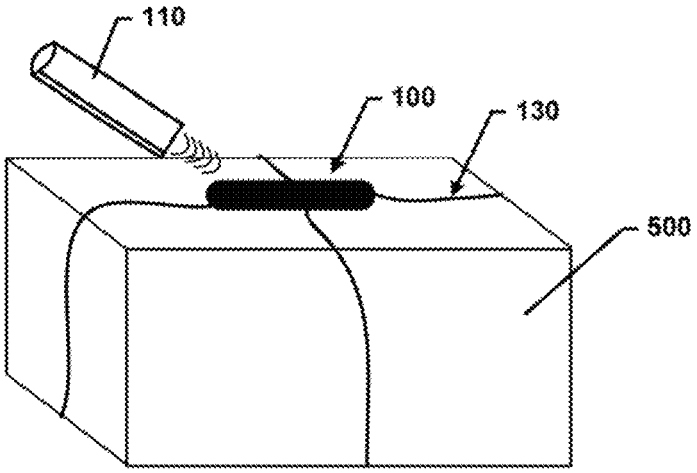
Figure 6E:
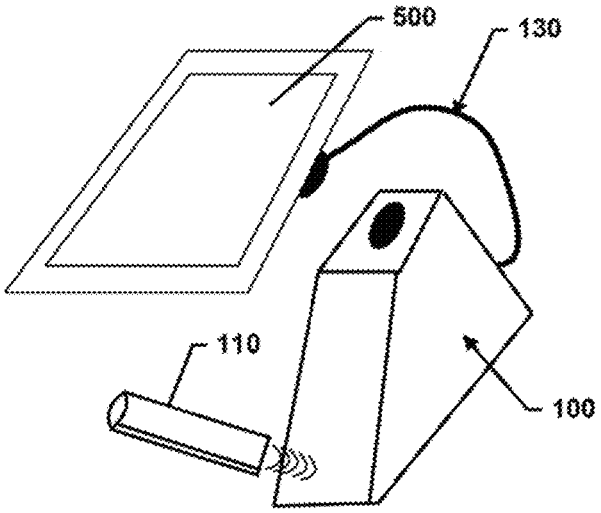
Figure 7:
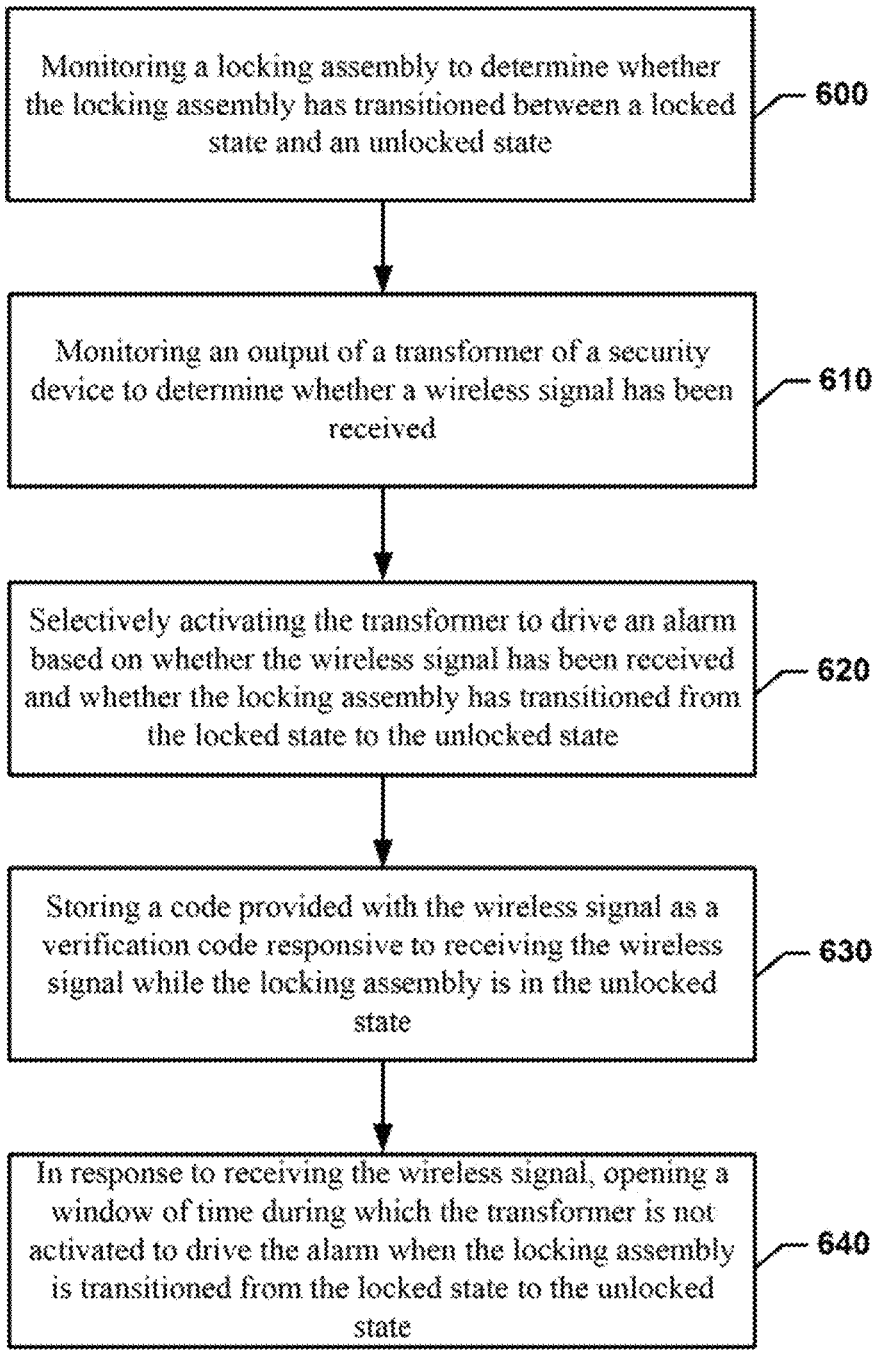

FIG. 6*a* illustrates a product being secured by a security device that is a cable lock according to an example embodiment;

FIG. 6*b* illustrates a product being secured by a security device that is a secure box safer according to an example embodiment;

FIG. 6*c* illustrates a product being secured by a security device that is a hard tag according to an example embodiment;

FIG. 6*d* illustrates a product being secured by a security device that is a cable wrap according to an example embodiment;

FIG. 6*e* illustrates a product being secured by a security device that is a display system according to an example embodiment; and FIG. 7 illustrates a block diagram of a method of employing a security device according to an example embodiment.

DETAILED DESCRIPTION

Some example embodiments now will be described more fully hereinafter with reference to the accompanying drawings, in which some, but not all example embodiments are shown. Indeed, the examples described and depicted herein should not be construed as being limiting as to the scope, applicability, or configuration. These example embodiments are provided to satisfy applicable legal requirements. Like reference numerals refer to like elements throughout. Furthermore as used herein, the term "or" is to be interpreted as a logical operator that results in true whenever one or more of its operands are true. As used herein, "operable coupling" should be understood to relate to direct or indirect connection that, in either case, enables functional interconnection of components that are operably coupled to each other.

Some example embodiments may enable provision of a security device that utilizes a transformer that operates in a dual function mode to both drive an alarm assembly and to provide an input to a processor of the security device to, for example, listen for and receive a verification code provided by a key or unlocking device via a wireless transmission. By utilizing the dual function transformer, the overall cost of the security device controlled, while providing additional functionality. Some security devices that, for example, unlock with only a magnetic key, may enjoy a further level of security to avoid the possibility that sophisticated thieves might employ stolen magnetic keys or make their own magnetic keys.

Figure 1:
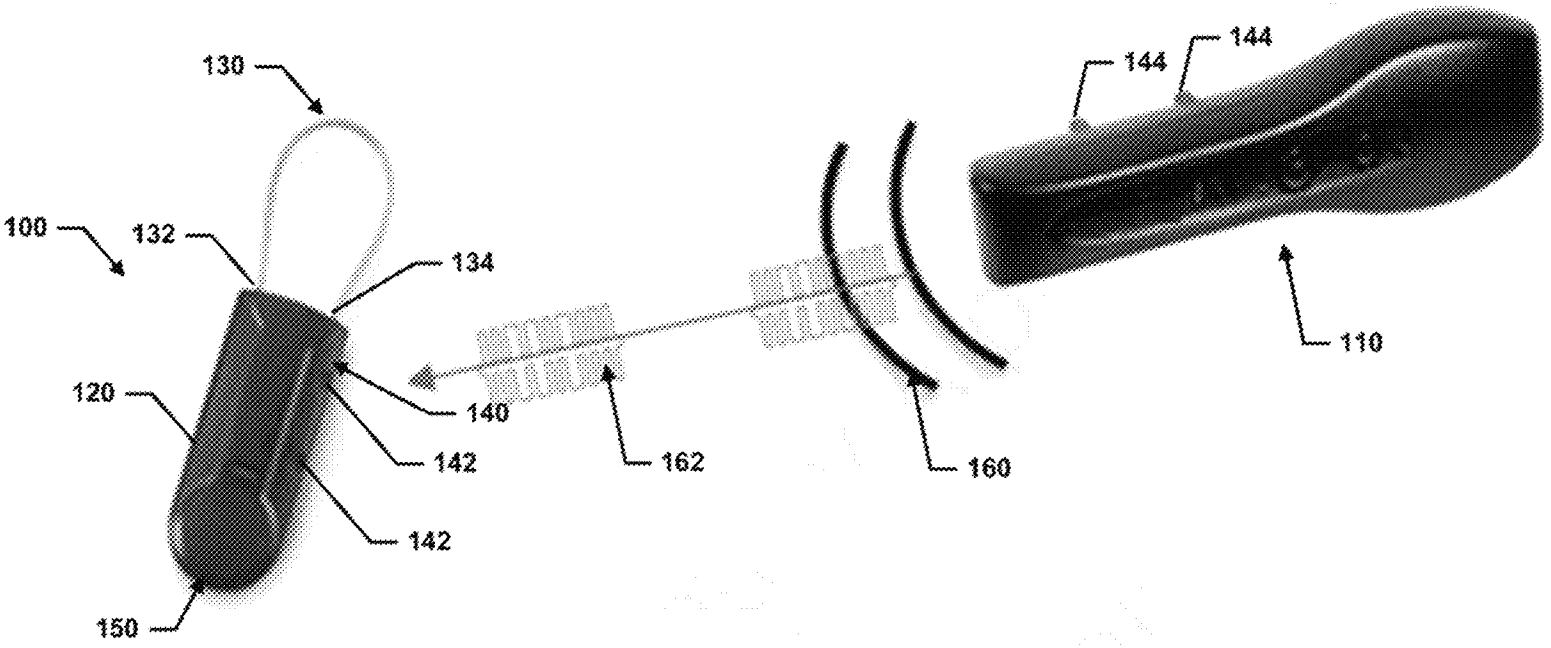
FIG. 1 illustrates an example security device and corresponding key according to some example embodiments.

FIG. 1 illustrates an example of a security device 100 and key 110 that may benefit by employing an example embodiment. In this regard, the security device 100 may include a housing 120 and an attachment assembly 130. The attachment assembly 130 may, in some cases, be embodied as a cable, lanyard, or other such flexible member that may be extended around or through a portion of a merchandise item. In some example embodiments, the attachment assembly may include a set of cables that can wrap around, for example, a box and be locked into the housing. Further, in some example embodiments, the attachment assembly may include a pin that cooperatively operates with, for example, a bell clutch that locks the pin to a housing of the security device. Further, in some example embodiments, the attachment assembly may be an adhesive surface or a locking bracket coupled with a sensor switch that detects when the product is removed from the adhesive surface. Additionally, in some example embodiments, the attachment assembly may include a secure box with a lockable lid for attachment to the merchandise item by being placed in the secure box. As provided in FIG. 1, the attachment assembly 130 may have a fixed end 132 and a releasable end 134 so that one end (i.e., the fixed end 132) of the attachment assembly 130 remains in fixed attachment with the housing 120, while the other end (i.e., the releasable end 134) can alternately be either locked into attachment with the housing 120 or unlocked so that the releasable end 134 is enabled to be released from the housing 120 and be freely maneuvered (e.g., for facilitating engagement with the merchandise item). The releasable end 134 may be transitioned between the locked and unlocked states via operation of a locking assembly 140. In some example embodiments, the fixed end 132 may also be releasable and may operate similar to the releasable end 134.

Although not visible in FIG. 1, the locking assembly 140 may further include components disposed within the housing 120 and/or at the releasable end 134 that are used for alternately locking and unlocking the locking assembly 140. In an example embodiment, the locking assembly 140 may be configured to lockably secure the attachment assembly 130. In this regard, the locking assembly 140 may be configured to transition between at least a locked state and an unlocked state. For example, in the locked state the releasable end 134 is secured at the housing 120 and in the unlocked state the releasable end 134 is not secured. Although not required, in some embodiments, the locking assembly 140 may include one or more magnetically responsive lock elements 142 that are biased toward a locking position to lock the attachment assembly 130 in the locked state, but which may be withdrawn (thereby transitioning to the unlocked state) responsive to the placement of the key 110 proximate thereto. In particular, the key 110 of some example embodiments may include a corresponding one or more magnets that may be placed proximate to the magnetically responsive lock elements, guided by the guide tabs 144 to detents 142, to withdraw the magnetically responsive lock elements and shift to the unlocked state so that the attachment assembly (e.g., via releasable end 134) is released.

In some example embodiments, the locking assembly 140 may include an electro-mechanical actuator that is controlled by the processing circuitry of the security device 100. The actuator, which may be a servo, motor, solenoid actuator, or the like, may be controlled to unlock the locking assembly without further interaction with an external device. As such, in response to receipt of a valid code, the processing circuitry of the security device 100, may be configured to move a locking member into an unlocked position, via the electro-mechanical actuator, to permit manual opening or unsecuring of the security device 100 from a protected product with the use of further tools (e.g., by manually opening the lid of a secure box, or by manually removing releasable end of the attachment assembly lanyard).

In some embodiments, the security device 100 may further include an alarm assembly 150, which may include an audio device (e.g., a piezoelectric, mechanical, or electromechanical beeper, buzzer, speaker, or other audio signaling device such as an audible alarm). In some cases, the alarm assembly 150 may also include visible indicia (e.g., lights of one or more colors such as a bi-color (e.g., red/green) LED). The visible indicia of the alarm assembly 150 and/or the audio device thereof may be used in various ways to facilitate or enhance operation of the security device 100. For example, different tones, sounds, or music may be played when the security device 100 receives different codes, or is operated in a certain way. Similarly, different light colors, light flash sequences or other visible indicia may be provided in combination with, or instead of, the audible indicia in order to indicate certain conditions (e.g., locked/unlocked state, receipt of a code, failed attempt to decode or encode, etc.).

The alarm assembly 150 may also be operably coupled to the locking assembly 140 and/or the attachment assembly 130 to facilitate the generations of an alarm (e.g., generate an audible tone or other noise) based at least in part on a state of either or both assemblies. Thus, for example, if the attachment assembly 130 is compromised (e.g., cut, damaged, or otherwise tampered with such that its integrity is compromised), the alarm assembly 150 may be configured to alarm. In the example embodiment of FIG. 1, the attachment assembly may include a sense loop that, if interrupted by, for example, being cut, will cause an alarm to be generated. Additionally or alternatively, if the locking assembly 140 is damaged, defeated, or otherwise shifted from the locked to the unlocked state in an unauthorized manner (e.g., prior to receipt of the validation code), the alarm assembly 150 may be configured to generate an alarm. As such, for example, although some embodiments may cause the alarm assembly 150 to alarm (or generate a alarm signal or output) when the attachment assembly 130 or the locking assembly 140 is compromised, some alternative embodiments may further cause the alarm assembly 150 to alarm whenever the locking assembly 140 shifts from the locked state to the unlocked state (e.g., responsive to unlocking of the lock elements 142 via the magnets 144) unless some additional authorization indicia is received.

In an example embodiment, the locking assembly 140 may include a switch or other circuitry configured to detect whether the locking assembly 140 is locked or unlocked. The switch may be monitored in series with a sense loop of the attachment assembly 130 or separately in different alternative embodiments. If such a switch is employed, the switch may act as a lock switch, the position of which is indicative of whether the security device 100 is in the locked state or the unlocked state. For example, if the lock switch is in the open position, the security device 100 (and the locking assembly 140) may be in the unlocked state. However, if the lock switch is in the closed position, the security device 100 may be in the locked state. In some embodiment, alarm conditions generated by the alarm assembly 150 may be generated based on certain detectable conditions based on whether the security device 100 is in the locked or unlocked state, or based on detected transitions between those states.

In some embodiments, the additional authorization indicia may be provided via the key 110 in the form of a validation code. While the key in FIG. 1 takes the form of a handheld device, it is understood that the key may take the form of a tabletop pad, ceiling mounted transmitter, or any other form factor that could house a wireless transmitter. In this regard, according to some example embodiments, the transmitter of the key and the mechanical/magnetic unlocking components may be disposed in separate and remote housings (e.g., the mechanical/magnetic unlocking components of the key may be mobile or tethered while the transmitter may be stationary). For example, the key 110 may be configured to provide a wireless signal 160 that may be used to deactivate the alarm generation function of the alarm assembly 150 under certain conditions. In this regard, for example, the wireless signal 160 may be used deactivate the alarm generation function of the alarm assembly and permit unlocking of the locking assembly 140 without triggering the alarm. To facilitate determining whether unlocking of the locking assembly 140 is authorized, some embodiments may employ a code 162 that may be carried by, or embodied by, the wireless signal 160. The wireless signal 160 may be provided at a particular frequency that is detectable by the security device 160 and may itself, based upon receipt thereof by the security device 100, enable the locking assembly 140 to be unlocked without triggering an alarm. However, in other cases, the wireless signal 160 may be received and decoded or otherwise processed to determine that the wireless signal 160 is authentic and/or properly authorizes unlocking of the locking assembly 140 without causing an alarm. In some embodiments, the determination may include confirming whether the transmitted code 162 matches a stored verification code. The code may be any suitable code such as, for example, a value or series of numbers or other characters that can be uniquely identified or otherwise determined to be authentic or matching with respect to a corresponding stored value or series of numbers or other characters. In some embodiments, the code 162 may employ on/off keying (OOK) as a modulation scheme for providing the code 162 via the wireless signal 160.

As indicated above, some example embodiments may utilize a transformer to facilitate both the driving of the alarm assembly 150 and the receipt of the wireless signal 160 at the security device 100. In particular, this dual use transformer may be configured to drive an audio device of the alarm assembly 150 to generate an audible alarm output when a processor or other processing circuitry of the security device 100 directs such output. Additionally, the dual use transformer may be further configured to operate a as a wireless receiver to receive a remotely transmitted wireless signal (with a code) that is received from outside of the housing 120. As such, the dual use transformer may be provided to be relatively unshielded within the housing 120 so that the wireless signal 160 transmitted by the key 110 may be received at a reasonable distance (e.g., from inches to feet away). However, some embodiments may be designed to transmit the wireless signal 160 (e.g., via inductive coupling) when the key 110 is proximate to the housing 120. Moreover, in some cases, the dual use transformer may be provided in the housing 120 at a location that will be substantially proximate to the location of the transmitter of the key 110 when the key 110 is held proximate to the security device 100 in a manner that enables the lock elements 142 to mate with the magnets 144.

Figure 2:
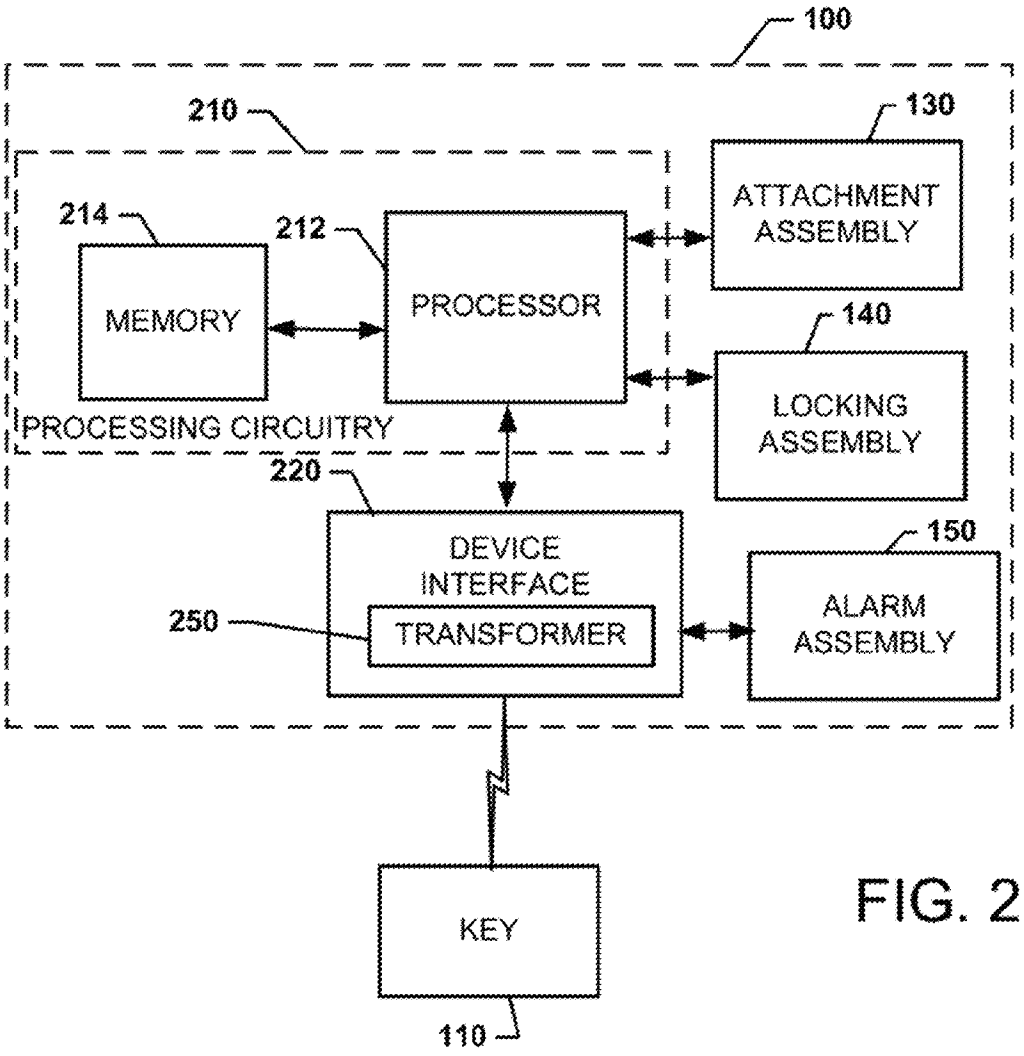
FIG. 2 illustrates a block diagram of some operational components of the security device of an example embodiment.

FIG. 2 illustrates a block diagram of the operational components of the security device 100 of an example embodiment. As shown in FIG. 2, the security device 100 may include processing circuitry 210 of an example embodiment as described herein. In this regard, for example, the security device 100 may utilize the processing circuitry 210 to provide electronic control inputs to one or more functional units of the security device 100 to obtain and/or process data associated with the one or more functional units and perform the subsequent security processes (e.g., locking, unlocking, alarming, etc.) described above in reference to FIG. 1. Although not shown, onboard power for the security device 100 may be provided by a battery or battery pack.

In some embodiments, the processing circuitry 210 may be embodied as a chip or chip set, possibly with other peripheral circuitry. In other words, the processing circuitry 210 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 210 may, in some cases, be configured to implement an embodiment of the present invention on a single chip or as a single "system on a chip." As such, in some cases, a chip or chipset may constitute means for performing one or more operations for providing the functionalities controlled by the processing circuitry as described herein.

In example embodiment, the processing circuitry 210 may include one or more instances of a processor 212 and memory 214 that may be in communication with or otherwise control a transformer 250, the attachment assembly 130, the locking assembly 140, and/or the alarm assembly 150. As such, the processing circuitry 210 may be embodied as one or more circuit chips (e.g., an integrated circuit chips) and possibly passive components configured (e.g., with hardware, software or a combination of hardware and software) to perform operations described herein. Thus, in some embodiments, the processing circuitry 210 may be embodied as a portion of an on-board computer of the security device 100.

The device interface 220 generically refers to all the interfaces between the security device 100 and external, peripheral devices. The device interface 220 may include one or more interface mechanism for enabling interaction and/or communication with other devices via electrical, mechanical, magnetic or other interaction. Thus, via the device interface 220 the ability to lock and/or unlock the locking assembly 140 based on magnetic influence provided by the key 110 may be provided. In some embodiments, the device interface 220 may include receiver circuitry configured to enable the security device 100 to receive wireless signals (e.g., the wireless signal 160) from external sources (e.g., the key 110). Thus, for example, the device interface 220 may include any means such as a device or circuitry embodied in either hardware, or a combination of hardware and software that is configured to receive data, wired or wirelessly, from devices or components enabled to establish communication with the processing circuitry 210 via external communication mechanism. In some cases, the device interface 220 may include wireless communication equipment (e.g., one or more antennas) for communicating with various devices. In still farther examples, the device interface 220 may include a transformer 250, which may be an example of the dual function transformer described above and may be leveraged to operate in a manner similar to an antenna for receiving and transmitting communications. The transformer 250 may be any suitable transformer that is capable of receiving an externally generated signal (e.g., via inductive coupling and/or by acting as a tuned receiver circuit with other components of the device interface 220) and enabling such signal to be processed by the processing circuitry 210 (which may include receiver circuitry configured to process the wireless signal and therefore may be tuned accordingly), while also being capable of driving circuitry of the alarm assembly to generate a alarm based on an input from the processing circuitry 210. In some embodiments the device interface 220 may include a tuned circuit optimized for reception at about 4 kHz, which may be a good frequency to drive a piezo sounder and also to enable inductive coupling for code reception. In some example embodiments, the transformer 250 may be or comprise a bobbin core inductor. The key 110 may, for example, include components to transmit a wireless signal via, for example, two inductors located on an end of the key 110, arranged to produce, in some example embodiments, a complex magnetic field. These inductors can be driven singularly, or in combination to generate fields to activate or otherwise interact with the security device 100.

Figure 3:
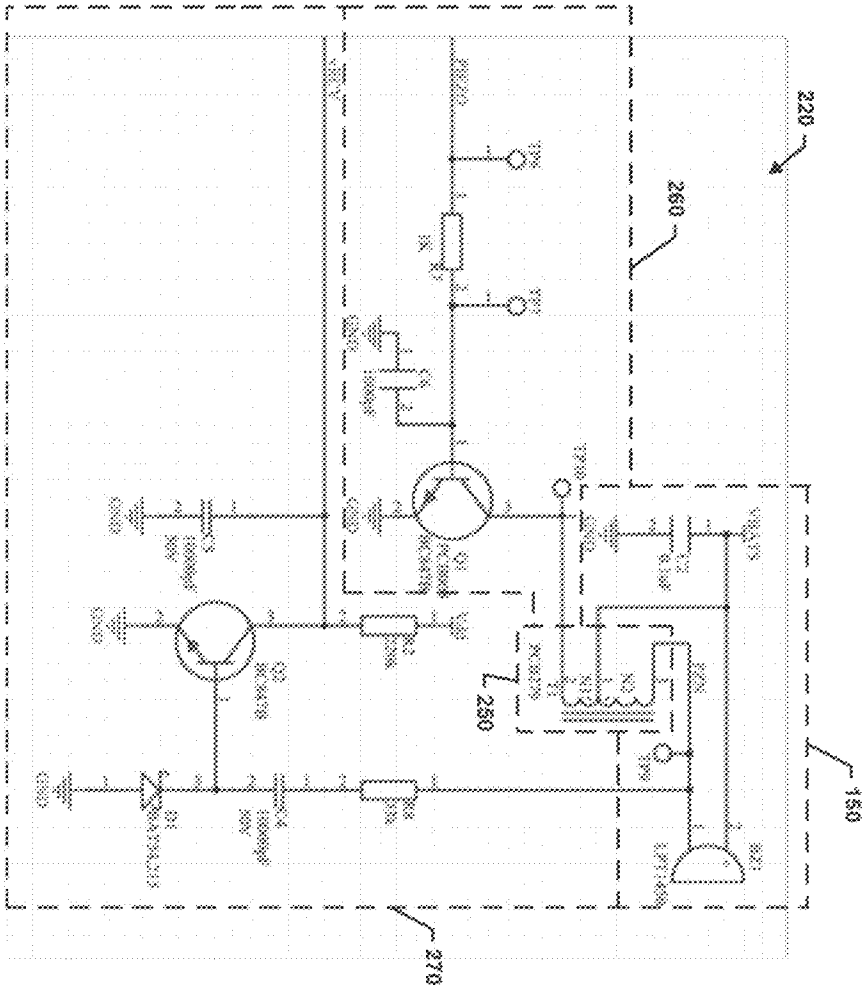
FIG. 3 illustrates an example circuit diagram of at least a portion of a device interface of an example embodiment.

The transformer 250, operating within a role associated with the device interface, may therefore perform the function of interfacing with external components (e.g., for potential receipt of transmitted codes), while also being configured to operate in a non-device interface role by driving the alarm assembly 150 (e.g., by providing a voltage step up function for driving a speaker, tone generator, piezo device, other audible alarm, or the like). FIG. 3 illustrates an example circuit diagram of at least a portion of the circuitry that could be implemented to support the dual operation of the transformer 250. In this regard, as shown in FIG. 3, the transformer 250 may interface with an alarm control portion 260 including circuitry for driving a piezo device, for example, when the processing circuitry directs the example alarm assembly 150 of FIG. 3 to alarm (or stops the alarm assembly 150 from alarming). The transformer 250 may also interface with a wireless signal receiver circuitry portion 270 that is configured to enable the processing circuitry 210 to receive and perhaps decode (if needed) a wireless signal communicated through the transformer 250. Although, buzzer BZI of FIG. 3 is not depicted as part of the wireless signal receiver circuitry portion 270, one of skill in the art would appreciate that the buzzer BZI may complement the operation of the transformer 250 to form a tuned circuit for receiving a wireless signal. According to some example embodiments, the transformer 250 may be a flyback connected transformer to boost the available voltage for driving the piezo device.

The processor 212 may be embodied in a number of different ways. For example, the processor 212 may be embodied as various processing means such as one or more microprocessors or other processing elements, coprocessors, controllers, or various other computing or processing devices including integrated circuits such as, for example, ASICs (application specific integrated circuits), FPGAs (field programmable gate arrays), or the like in association with appropriate supporting circuitry and components. In an example embodiment, the processor 212 may be configured to execute instructions stored in the memory 214 or otherwise accessible to the processor 212. As such, whether configured by hardware or by a combination of hardware and software, the processor 212 may represent an entity (e.g., physically embodied in circuitry—in the form of processing circuitry 210) capable of performing operations according to embodiments of the present invention while configured accordingly. Thus, for example, when the processor 212 is embodied as an ASIC, FPGA or the like, the processor 212 may be specifically configured hardware for conducting the operations described herein in reference to FIGS. 1 and 2. Alternatively, as another example, when the processor 212 is embodied as an executor of software instructions, the instructions may specifically configure the processor 212 to perform and\or control the operations described herein, for example, in reference to operations described with respect to FIGS. 1 and 2.

In an example embodiment, the processor 212 (or the processing circuitry 210) may be embodied as, include, or otherwise control the operation of the security device 100 based on received inputs. As such, in some embodiments, the processor 212 (or the processing circuitry 210) may be said to cause and/or control each of the operations described in connection with the security device 100 in relation to operation of the security device 100 relative to undertaking the corresponding functionalities associated therewith responsive to execution of instructions or algorithms configuring the processor 212 (or processing circuitry 110) accordingly. In particular, in some cases, the processor 212 may monitor the state of the locking assembly 140 (e.g., locked or unlocked) of the security device 100, the condition of a sense loop of the attachment assembly 130 (e.g., whether or not the sense loop has been compromised), and/or the presence or absence of a wireless signal (e.g., wireless signal 160) to make determinations as to whether to drive the alarm assembly 150 to generate an alarm condition. However, in some cases, monitoring for receipt of the wireless signal 160 may further include making a determination as to whether the received wireless signal carries the code 162, or at least carries a code that matches a verification code stored in memory 214. In some cases, the verification code may simply be the most recently stored code that was received, for example, while the locking assembly was in an unlocked state.

In a exemplary embodiment, the memory 214 may include one or more non-transitory memory devices such as, for example, volatile and/or non-volatile memory that may be either fixed or removable. The memory 214 may be configured to store information, data, applications, instructions, or the like for enabling the processing circuitry 210 to carry out various functions in accordance with example embodiments. For example, the memory 214 could be configured to buffer input data for processing by the processor 212. Additionally or alternatively, the memory 214 could be configured to store instructions for execution by the processor 212. As yet another alternative or additional capability, the memory 214 may include one or more datasets that may store a variety of codes, or at least one verification code, that enables the processor 212 to interface with the locking assembly 140 and/or alarm assembly 150 to cause or prevent an alarm condition from being generated by the alarm assembly 150 responsive to inputs received at the processor 212.

In some embodiments, the memory 214 may store a received or pre-programmed code, which may act as a verification code that, if matched, can be used by the processor 212 to permit unlocking of the security device 100 without alarming. If the locking assembly 140 is in the locked state, the code stored in memory 214 as the verification code may not be changed, and the security device 100 may only permitted to open or transitioned to the unlocked state by provision of the stored verification code. However, in some cases, if the locking assembly 140 is in the unlocked state and the alarm assembly 150 is not alarming, the verification code may be replaced with a new verification code. The first code received by the security device 100, via the transformer 250, may therefore act as the verification code for the security device 100 until some other code is provided to replace the first code when the locking assembly 140 is in the unlocked state and the alarm assembly ISO is not alarming. In some embodiments, the most recently received code while the security device 100 is in the unlocked, non-alarming state may overwrite the last code and become the new verification code. Thus, the verification code may be changed any number of times while the security device 100 is in the unlocked, non-alarming state.

The processes governing operation of the processor 212 relative to locking, unlocking, and alarm generation may be governed by algorithms and/or applications that are executed based on stored instructions in the memory 214. Thus, for example, among the contents of the memory 214, one or more security device control applications may be stored for execution by the processor 212 in order to carry out the functionality associated with each respective application. In some cases, the applications may include instructions for carrying out some or all of the operations described in reference to the example algorithms of FIGS. 4 and 5.

Figure 4:
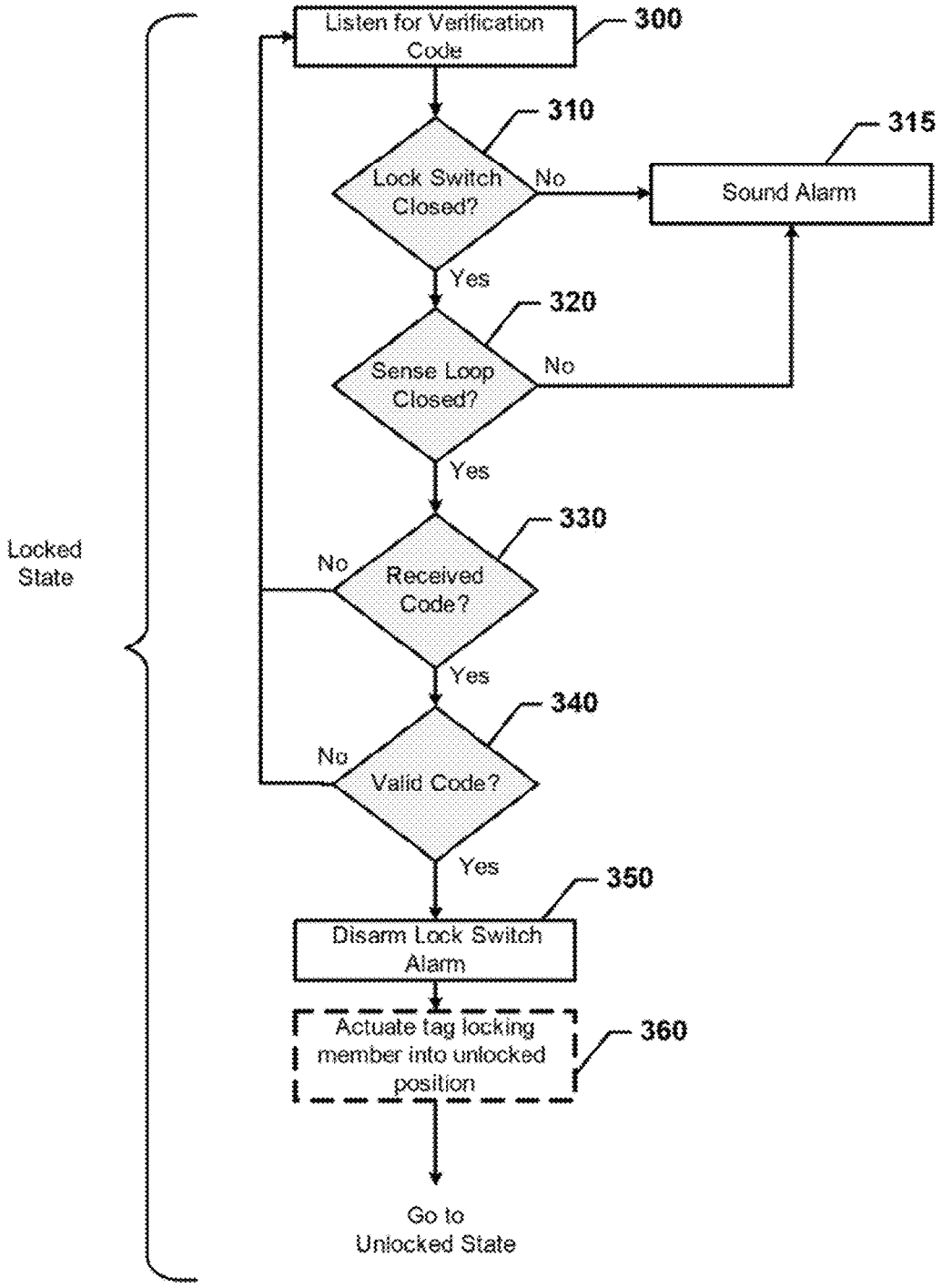
FIG. 4 illustrates a block diagram of an example algorithm directing operation of the security device in a locked state according to an example embodiment.
Figure 5:
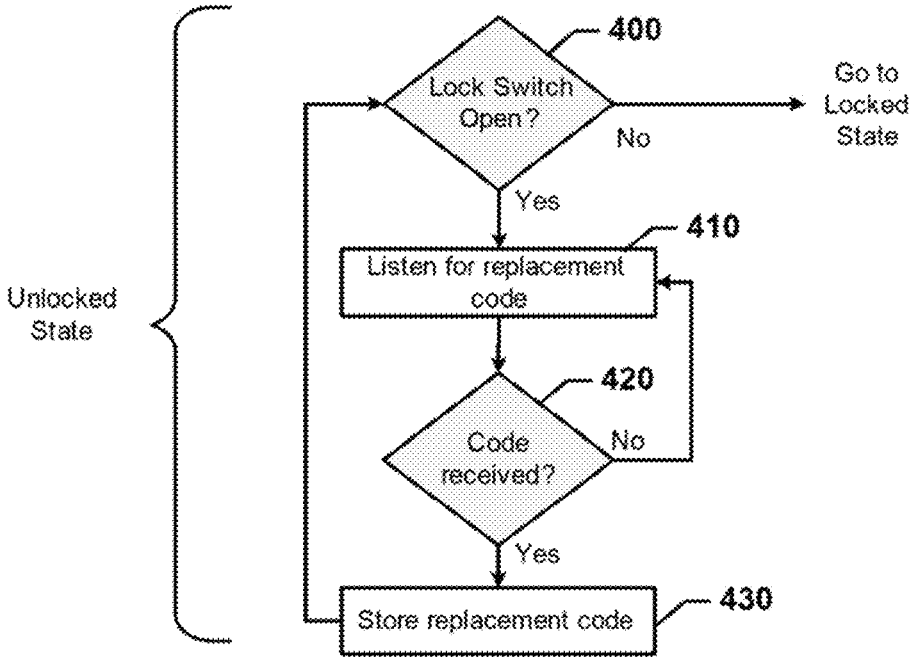
FIG. 5 illustrates a block diagram of an example algorithm directing operation of the security device in an unlocked state according to an example embodiment.

FIG. 4 illustrates a block diagram showing operation of the security device 100 in a locked state in accordance with an example embodiment. FIG. 5 illustrates a block diagram showing operation of the security device 100 in an unlocked state in accordance with an example embodiment. It should be appreciated that in one example embodiment, the actions of the security device 100 as performed in accordance FIGS. 4 and/or 5, may be carried out or directed by the processing circuitry 210. Furthermore, the examples of FIGS. 4 and 5 are each directed to examples in which the wireless signal 160 includes a code (e.g., the code 162). However, other more simple examples may operate with respect to receipt of any wireless signal, possibly without a code, so long as the signal can be detected.

Referring to FIG. 4, the security device 100 may be configured to listen for a verification code at operation 300 while in the locked state. At operation 310, the security device 100 may determine whether a lock switch of the locking assembly 140 is closed. If the lock switch is not closed (e.g., the locking assembly has transitioned from a locked state to an unlocked state without having first received a verification code), an alarm may be configured to sound at operation 315. If the lock switch is closed, a determination may be made at operation 320 as to whether the sense loop is closed. If the sense loop is not closed, the alarm may sound at operation 315 because the security device 100 has been tampered with and the sense loop has been compromised (e.g., cut). If the sense loop is closed, a determination may be made at operation 330 as to whether a transmitted code has been received. If no transmitted code is received, operation may return to listening for a verification code at operation 300. If a transmitted code is received, a determination may be made as to whether the transmitted code is valid at operation 340. To determine if the code is valid or verified, the received code may be compared to a stored code to determine whether the codes match or have some predefined relationship such as, for example, via a hashing function, conjugate, or the like. It is understood that in some embodiments, the wireless signal may have characteristics (e.g., frequency, waveform, etc.) that can be compared to stored information or otherwise analyzed to validate or verify the signal. If the transmitted code is not valid, the cycle may again return to operation 300, or in some example embodiments, the process may flow to 315 and an alarm may be sounded to indicate that an unauthorized attempt to disarm the device has occurred. However, if the code is valid, then the lock switch alarm may be disarmed at operation 350 thereby permitting the security device 100 to be unlocked without sounding the alarm.

In some embodiments, in association with the lock switch alarm function being disabled at operation 350, the security device 100 may be enabled to transition to the unlocked state. The transition may be directed electronically (e.g., by receipt of the valid code), or the transition may be accomplished manually (e.g., by the operator actuating a switch to the unlocked state by using the key 110 to unlock the locking assembly 140), or by a combination of electronic and manual operations. When electronic methods are employed, some embodiments may utilize a servo, motor, solenoid actuator, or other electro-mechanical actuation device that, when in receipt of the valid wireless signal or code, may be driven to cause a mechanical unlocking of the security device 100. Thus, for example, if a tag locking member of the locking assembly 140 is actuated to the unlocked position at optional operation 360, the security device 100 may transition to the unlocked state to permit manual opening or unsecuring of the attachment assembly without the further use of unlocking tools. In this example embodiment the process of unlocking the security device may be accomplished internal to the security device, in response to receipt of the valid signal or code, without the need for farther interaction with any external magnetic fields or external mechanical actuation to unlock the security device.

When in the unlocked state, as shown in FIG. 5, a determination may be made at operation 400 as to whether the lock switch is open. If the lock switch is closed (i.e., not open), the security device may transition to the locked state. If the lock switch is open and the alarm is not sounding, then the device remains in the unlocked state, and may listen for a replacement code at operation 410. A determination may then be made at operation 420 as to whether a replacement verification code is received. If no new code is received, then the security device 100 may continue to listen for a replacement verification code by cycling back to operation 410. However, if a new verification code is received, the new verification code may be stored (e.g., in memory 214) at operation 430. The security device 100 may remain in the unlocked state and continue to monitor the lock switch position at operation 400.

In some embodiments, the processing circuitry 210 may further incorporate a timer or timing function in connection with the operation of some embodiments. The timer may be used to detect and/or act upon certain conditions within a given period of time. Alternatively or additionally, the timer may operate to ensure proper sequencing or delay between certain actions or activities to achieve desired functionality. In some cases, the timer may open a window during which unlocking of the locking assembly 140 may be performed after verifying a received wireless signal (e.g., by determining a frequency or other characteristics of the signal, or by determining that code provided within the wireless signal is a valid verification code). In other words, upon receipt of a valid verification code, a window of time is opened during which the locking assembly may be transitioned from a locked state to an unlocked state (e.g., via use of the magnetic key) without sounding the alarm. If the window closes (e.g., the timer elapses) before the locking assembly transitions to the unlocked state, then the security device may become re-armed and another instance of the receiving the verification code may be required to re-open the window to unlock the locking assembly without sounding the alarm.

Furthermore, when the security device 100 is alarming, the security device 100 may also need to listen for a transmitted code to silence the alarm. Accordingly, a timer may be used to define a listening period while alarming. For example, a short listening period (e.g., about 30 ms) may be defined at periodic intervals while the security device 100 is alarming. During the listening period, the security device 100 may stop alarming, and may listen for a wireless signal or code (e.g., at 4 KHz). If the wireless signal or code is received, the processing circuitry 210 may operate to determine whether to stop the alarming condition upon receipt of a valid code. However, if no wireless signal or code is received, then the security device 100 may return to the alarming condition and continue to generate the audible alarm until the next listening period arrives. In cases where the wireless signal includes a coded message, the wireless signal may begin with a preamble or start bit. Thus, any receipt of such preamble or start bit at any time during the listening period may cause the security device 100 to exit the alarm condition until the entire code can be received and processed. If an entire code is not received, the security device may revert back to the alarming state. Thus, the listening period may not be so rigidly defined as to cut off opportunities to decode messages received at the end of the listening period or messages that might be longer than the listening period.

Some example embodiments may therefore utilize the transformer 250 as a dual function transformer that can both drive the alarm assembly 150 (e.g., by driving a piezo sounder) and also act as a wireless communication receiver. The key 110 may provide a wireless signal (and/or code) that is received via the transformer 250 and can be used to deactivate or prevent alarming of the security device 100 (or tag) based on a verification process. FIGS. **6*e*-6*e* illustrate some but not all implementations of a security device 100 that may utilize the functionalities described herein. FIG. 6*a* illustrates an example of a product 500 (e.g., retail merchandise) that may be secured by the security device 100 and key 110 of an example embodiment. As shown in FIG. 6*a*, the attachment assembly 130 of a security device 100 in the form of a cable lock device may wrap around a portion of the product 500. Any compromise of the attachment assembly 130 (e.g., by cutting the cable), or unlocking of the security device 100 in the absence of the wireless signal 160 (or a wireless signal based on receipt of the code therewith) may result in an alarm sound being generated by the security device 100. Thus, for example, if a magnet key is used to physically unlock the security device 100 and enable the attachment assembly 130 to be removed from the product 500 without provision of the wireless signal 160 (or the code), the security device 100 may activate an alarm (e.g., a local audible alarm). FIG. 6*b* illustrates an implementation of a security device 100 as a secure box safer with a lockable lid. The product 500 may be secured within the security device and the attachment assembly 130** may comprise the lockable lid. FIG. 6*c* illustrates an implementation of a security device 100 as a hard tag. The product 500 may be secured to the had tag via pin and a pin lock (e.g., a bell clutch) of the attachment assembly 130. FIG. 6*d* illustrates an implementation of a security device 100 as a cable wrap. The product 500 may be secured to the cable wrap security device via a plurality of cables of the attachment assembly 130 that wrap around the product 500 to secure the cable wrap security device to the product. FIG. 6*e* illustrates an implementation of a security device 100 as a display system. The product 500 may be secured to the display system via a sensor and a cable of the attachment assembly to secure the display system security device to the product. The sensor may be secured to the product 500 via an adhesive or a locking bracket.

The key 110 (also referred to as a user key) may be programmed with a verification code to be transmitted to security devices by a manager key device. The manager key device may include a memory that stores the verification code and is read by the key 110 when the manager key is inserted into the key 110. Upon reading the verification code from the manager key, the key 110 may store the code for subsequent use. The key 110 may be mobile in some instances and therefore may be carried around by authorized personnel. However, in some instances the key 110 may be tethered. The key 110 may have programming provided therein to enable the key 110 to have an awareness of whether it is a portable or tethered key. As described earlier, the key 110 may be programmed with a verification code that may or may not be changed over time. This may be the same verification code that is transmitted to the security device to deactivate the alarm and permit unlocking of the device without sounding an alarm. In some cases, the key 110 may interact with a manger key or another device (e.g., a docking station or computer terminal) to receive programming updates and/or verification codes. In embodiments in which a manager key is employed, the manager key may either be factory coded or may be blank. The blank manger key may programmed by a user key (e.g., key 110) that was previously programmed by a factory coded manager key or programmed manager key, provided, for example, that the blank manager key has been inserted into the user key within 5 seconds of the factory coded manager key or another programmed manger key being inserted into the user key. This may enable multiple manager keys and, in turn multiple user keys, to be used in a particular store with the same code.

In example embodiments that employ a tethered user key, the user key may be battery powered and may include magnets described above, which may be spaced apart to define locating features for interface with the security device 100. The tethered key may also include an interface for the manager key and/or docking station. In some cases, the tethered key may further include electronics to support transmission of wireless signals along with acousto-magnetic (AM) and radio frequency (RF) EAS security elements. The tether may have a desired length that may limit the mobility of the key. The portable key may be the same as the tethered key except that it may not have the tether, and the portable key may include provision for controlling use of the key.

In some cases, the key 110 may have a button or other device to initiate code transmission. When a code is transmitted to the security device 100, the security device 100 may make an audible sound (e.g., chirp) on receipt of the transmitted code. In some cases, a different chirp or sound may be provided when a valid verification code is received versus when an unrecognized code is received. Alternatively or additionally, lights may be used to indicate receipt of various codes. The operator may have a fixed time period to manipulate the security device 100 to detach the security device from the product 500 after the code is received and unlocking is permitted.

The manager key and/or the key 110 may be provided with verification codes. Similarly, the security device 100 may initially have not code stored therein, or may have a preprogrammed or default code therein. When the codes are blank, the manager key may be provided with a code unique to a location or organization so that, for example, the keys associated with the location or organization may use unique codes. The security devices 100 may then be coded with the unique code for the location or organization via the keys, for example, as described above. The programming may be accomplished prior to placement of the security devices 100 onto products. However, in some cases, the security devices 100 may simply be used with a default code (or no code) until they me first brought to a point of sale or other terminal at which a key may be located. The security device 100 may be unlocked initially with the default code (or may be unlocked without any code) and then the security device 100 may be coded by overwriting the initial code or providing an initial code using the key when it is first unlocked at the point of sale.

FIG. 7 illustrates a block diagram of a method of employing a security device in accordance with an example embodiment that may be performed, for example, by processing circuitry. The method may include, at 600, monitoring a locking assembly to determine whether the locking assembly has transitioned between a locked state and an unlocked state. In some example embodiments, the monitoring of the locking assembly may be configured to lockably secure an attachment assembly to an object. The processing circuitry, the locking assembly, and the attachment assembly may be components of a security device. The method may further include, at 610, monitoring an output of a transformer of a security device to determine whether a wireless signal has been received. The method may also include, at 610, monitoring an output of a transfer of a security device to determine whether a wireless signal has been received.

Additionally, at 620, the method may include selectively activating the transformer to drive an alarm based on whether the wireless signal has been received and whether the locking assembly has transitioned from the locked state to the unlocked state. In some example embodiments, selectively activating the transformer to drive the alarm comprises determining whether the wireless signal includes a transmitted code that matches a verification code stored on the security device. In some example embodiments, the method may further include storing a code provided with the wireless signal as a verification code responsive to receiving the wireless signal while the locking device is in the unlocked state, and in some example embodiments, while the alarm assembly is not alarming. Further, in some example embodiments, the method may alternatively or additionally include, in response to receiving the wireless signal, opening a window of time during which the transformer is not, and may not be, activated to drive the alarm (audible) when the locking assembly is transitioned from the locked state to the unlocked state.

Example embodiments may provide a security device that can effectively protect a product to which it is attached from theft by alarming if the security device is not properly removed from the product. However, example embodiments may further enable the provision of a wireless signal or other code that can be remotely provided to further secure the product by ensuring that any key that might be used to unlock the security device to permit removal from the product is also required to provide the correct wireless signal or code to enable unlocking without alarm generation. The provision of the code is provided by the same transformer that is used to drive the alarm. Thus, by using a dual function transformer, device capabilities may be expanded without a substantial addition of components and therefore minimizing additional cost. Overall cost to a retailer using instances of the security device to protect products may therefore be minimized.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems re described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A security device comprising:

an attachment assembly configured to affix the security device to an object;

a locking assembly configured to lockably secure the attachment assembly, the locking assembly being configured to transition between at least a locked state and an unlocked state;

a transformer configured to drive an alarm assembly to generate an alarm, the transformer being further configured to operate as a wireless receiver to receive a remotely transmitted wireless signal; and processing circuitry configured to:

monitor an output of the transformer to determine whether the wireless signal has been received via the transformer; and selectively activate the transformer to drive the alarm assembly to generate the alarm.

2. The security device of claim 1, wherein the processing circuitry is further configured to activate the transformer to drive the alarm assembly to generate the alarm in response to the attachment assembly being compromised.

3. The security device of claim 1, wherein the processing circuitry is further configured to activate the transformer to drive the alarm assembly to generate the alarm in response to determining that the locking assembly has transitioned from the locked state to the unlocked state without having received the wireless signal via the transformer.

4. The security device of claim 1, wherein the attachment assembly includes a sense loop, and wherein processing circuitry is further configured to activate the transformer to drive the alarm assembly to generate the alarm in response to the sense loop being compromised.

5. The security device of claim 1, wherein the processing circuitry is further configured to, in response to receiving the wireless signal:

receive the remotely transmitted wireless signal via the transformer;

verify the remotely transmitted wireless signal; and open a window of time during which activation of the transformer to drive the alarm assembly is prevented, to permit the locking assembly to be transitioned from the locked state to the unlocked state without generating an alarm.

6. The security device of claim 1, wherein the wireless signal comprises a transmitted code.

7. The security device of claim 6, further comprising a memory configured to store a verification code, and wherein the processing circuitry is further configured to determine whether the transmitted code matches the verification code.

8. The security device of claim 7, wherein the verification code is fixed during the locked state, and wherein the verification code is programmable during the unlocked state.

9. The security device of claim 6, further comprising a memory configured to store a verification code, and wherein the processing circuitry is further configured to overwrite the verification code with the transmitted code responsive to receipt of the transmitted code while the security device is in the unlocked state.

10. The security device of claim 1, wherein the alarm assembly comprises a piezo sounder.

11. The security device of claim 1, wherein the transformer forms a portion of a tuned circuit configured to receive the wireless signal.

12. The security device of claim 11, wherein the tuned circuit is configured to receive the wireless signal from an electronic key, the electronic key comprising at least one magnet configured to magnetically interact with the security device to transition the security device to the unlocked state.

13. The security device of claim 1, wherein the processing circuitry is configured to define a listening period during generation of the alarm to enable the transformer to stop driving the alarm assembly to listen for the wireless signal.

14. A method comprising:

monitoring, via processing circuitry, a locking assembly configured to lockably secure an attachment assembly to a object, wherein the monitoring of the locking assembly determines whether the locking assembly has transitioned between a locked state and an unlocked state, wherein the processing circuitry, the locking assembly, and the attachment assembly are components of a security device;

monitoring an output of a transformer of the security device, via the processing circuitry, to determine whether a wireless signal has been received via the transformer; and selectively activating the transformer to drive an audible alarm based on whether the wireless signal has been received and whether the locking assembly has transitioned from the locked state to the unlocked state.

15. The method of claim 14, wherein selectively activating the transformer to drive the audible alarm comprises determining whether the wireless signal includes a transmitted code that matches a verification code.

16. The method of claim 14, further comprising storing a code provided with the wireless signal as a verification code responsive to receiving the wireless signal while the locking assembly is in the unlocked state.

17. The method of claim 14, further comprising, in response to receiving the wireless signal:

receiving the wireless signal via the transformer;

verifying the wireless signal; and opening a window of time during which activation of the transformer to drive the alarm assembly is prevented, to permit the locking assembly to be transitioned from the locked state to the unlocked state without generating an alarm.

18. A device interface for a security device that is affixable to an object, the device interface comprising:

receiver circuitry configured to detect receipt of a wireless signal; and a transformer in communication with the receiver circuitry and in communication with an alarm assembly of the security device to selectively drive the alarm assembly responsive to instruction from processing circuitry of the security device, the processing circuitry being configured to:

determine whether a locking assembly configured to lockably secure an attachment assembly of the security device is in a locked state or an unlocked state;

monitor to determine whether the wireless signal has been received via the transformer; and selectively activate the transformer to drive the alarm assembly to generate an alarm.

19. The device interface of claim 18, wherein the transformer forms a portion of a tuned circuit configured to receive the wireless signal.

20. The security device of claim 18, wherein the tuned circuit is configured to receive the wireless signal from an electronic key, the electronic key comprising at least one magnet configured to magnetically interact with the security device to transition the security device to the unlocked state.

* * * * *